United States Patent [19]

Gilliams et al.

[11] 4,161,453

[45] Jul. 17, 1979

[54] ELECTROPHORETIC DEVELOPERS

[75] Inventors: Yvan K. Gilliams, Hever; Noel J. De Volder, Edegem, both of Belgium

[73] Assignee: AGFA-GEVAERT N.V., Mortsel, Belgium

[21] Appl. No.: 817,264

[22] Filed: Jul. 20, 1977

[30] Foreign Application Priority Data

Jul. 23, 1976 [GB] United Kingdom ..... 30920/76

[51] Int. Cl.[2] ..... G03G 9/12

[52] U.S. Cl. ..... 252/62.1 L; 96/1 LY; 260/23 S; 260/23 ST

[58] Field of Search ..... 252/62.1 L, 62.1 R; 96/1 LY; 260/23 S, 23 ST; 427/15, 16, 17

[56] References Cited

U.S. PATENT DOCUMENTS

| | | | |
|---|---|---|---|
| 2,940,946 | 6/1960 | Shokal et al. | 260/23 S |
| 3,623,986 | 11/1971 | Machida et al. | 252/62.1 L |
| 3,668,127 | 6/1972 | Machida et al. | 252/62.1 L |
| 3,909,433 | 9/1975 | Gilliams et al. | 96/1 LY |

*Primary Examiner*—John T. Goolkasian
*Attorney, Agent, or Firm*—William J. Daniel

[57] ABSTRACT

A liquid developer composition suitable for use in developing electrostatic charge patterns, which composition contains in an electrically insulating non-polar carrier liquid a dispersed particulate coloring substance, at least one charge control substances, a copolymer (I) precoating the coloring substance particles in a weight ratio of copolymer (I) to coloring substance between 1:1 and 9:1 and a copolymer (II) in the carrier liquid in a weight ratio of copolymer (II) to coloring substance between 0.5:1 and 5:1, said copolymer (I) being a copolymer consisting of 50 to 90 mole % of recurring units of the following formula (A)

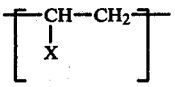

(A)

wherein X is phenyl or alkylphenyl, and from 10 to 50 mole % of recurring units of the following formula (B)

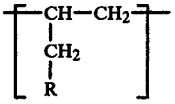

(B)

wherein R is a hydroxyl group or is a group resulting from the esterification of hydroxyl by means of a $C_{12}$–$C_{20}$ aliphatic acid with the proviso that the copolymer (I) contains at least 0.5% by weight of free hydroxyl groups, and said copolymer (II) being a copolymer selected from the group consisting of a copolymer of at least one $C_{12}$–$C_{20}$ alkyl ester of methacrylic acid (X) and the n-butyl or isobutyl ester of methacrylic acid (Y)

a copolymer of X, Y and up to 70% by weight of styrene or a styrene homologue, and a copolymer of X, Y and up to 0.4% by weight of methacrylic acid, the weight ratio of X to Y in these copolymers being comprised between 15:85 and 50:50.

13 Claims, No Drawings

ELECTROPHORETIC DEVELOPERS

The present invention relates to liquid developers suitable for use in electrophoretic development of electrostatic charge patterns.

An electrostatographic process known as electrophotography comprises the steps of electrostatically charging in the dark a photoconductive surface and image-wise exposing said surface, whereby the iradiated areas become discharged in accordance with the intensity of radiation thus forming a latent electrostatic image. The formation of a visible image proceeds by supplying to the image-wise charged material a finely divided electroscopic material known as "toner". The toner is image-wise electrostatically attracted or repulsed so that a direct or reversal toner image of the pattern represented by the charge density distribution is obtained. The toner image may be fixed to the surface of the photoconductor or transferred to another surface and fixed thereon.

Instead of forming the electrostatic image by the steps described above it is also possible to charge directly a dielectric material in image configuration, e.g. with a charged stylus, or through photo-electron emission or ionography.

Historically, a one-component dry powder toner was first used for developing electrostatic images. Other development processes, known at present as cascade, fur brush, powder cloud, magnetic brush, and liquid electrophoretic development were introduced.

Developers of the electrophoretic type initially comprised a simple dispersion of a pigment but no binder. It was later proposed, e.g. by Metcalfe and Wright, J. Oil Colour Chem. Ass., 39 (1956) 851–843, to use liquid developers incorporating resins and control agents. The resultant images are then made of so-called "self-fixing" toners.

In liquid developers comprising coloured toner particles suspended in an insulating carrier liquid, the volume resistivity of the liquid is preferably in excess of $10^9$ Ohm.cm and its dielectric constant is below 3. The suspended toner particles, which usually comprise finely divided pigments (which expression includes dyes in pigment form), obtain an electric charge of a definite polarity by means of a so-called charge control agent and develop the latent image under influence of the charge of the latent electrostatic image.

The charging of the toner particles can be achieved by the addition of oil-soluble ionogenic substances, e.g. metallic salts of organic acids with sufficiently long aliphatic chains. By predominant adsorption of one ionic species the particles receive a net charge whose amount can be regulated simply by changing the additive concentration. The polarity is controlled by the appropriate choice of ionogenic substance.

The resin in an electrophoretic pigment-resin toner combination is used primarily to provide a good dispersion stability and adhesion of dried toner to its final support e.g. a receiving sheet of paper, resin, or metal.

The transfer of a still wet toner image to a receptor paper is of interest e.g. in plain paper electrophotography in which the photoconductor member, e.g. the selenium drum, after transfer of the toner image is reused for recharging and information-wise exposure.

The transfer of the toner image e.g. from a conventional zinc oxide paper to a printing plate base, is of particular interest in the economical manufacture of planographic printing plates.

Many liquid developers when used in toner transfer systems yield transfer images of poor density and form a toner deposit that is easily rubbed off and is not fit for forming a wear-resistant ink accepting pattern in planographic printing.

In the production of transfer images on planographic printing supports, e.g. aluminium sheets or plates, the transferred toner images should possess a good water resistance, tenacious adherence, and abrasion resistance as well as a satisfactory resolution.

Accordingly, there is a need in the art for resins for liquid toner developer compositions, which provide the above defined properties to the toner. There is a further need for such liquid toner developer compositions, which retain their charge and dispersion stability for extended periods of time and which do not deteriorate with age or upon exposure to the atmosphere.

Therefore, it is an object of the present invention to provide new stable liquid toner developer compositions that are capable of producing dense toner images that can be transferred to produce excellent long run planographic printing masters as a result of their strong erasure-resistance.

It is another object of the present invention to provide liquid toner developer compositions containing synthetic resin constituents giving the toner such desired properties in a reproducible way.

In accordance with the present invention a liquid developer composition is provided that is suitable for use in developing electrostatic charge patterns, which composition contains in an electrically insulating non-polar carrier liquid a dispersed particulate colouring substance, one or more charge-control substances, a copolymer (I) in a weight ratio of copolymer (I) to colouring substance between 1:1 and 9:1 and a copolymer (II) in a weight ratio of copolymer (II) to colouring substance between 0.5:1 and 5:1, said copolymer (I) being a copolymer consisting of 50 to 90 mole % of recurring units of the following formula (A)

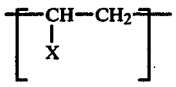

(A)

wherein X is phenyl or alkylphenyl, and from 10 to 50 mole % of recurring units of the following formula (B)

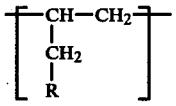

(B)

wherein R is a hydroxyl group or is a group resulting from the esterification of hydroxyl by means of a $C_{12}$–$C_{20}$ aliphatic acid with the proviso that the copolymer (I) contains at least 0.5% by weight of free hydroxyl groups, and said copolymer (II) being a copolymer selected from the group consisting of a copolymer of at least one $C_{12}$–$C_{20}$ alkyl ester of methacrylic acid (X) and the n-butyl or isobutyl ester of methacrylic acid (Y)

a copolymer of X, Y and up to 70% by weight of styrene or a styrene homologue, and a copolymer of X, Y and up to 0.4% by weight of methacrylic acid, the weight ratio of X to Y in these copolymers being comprised between 15:85 and 50:50.

Particularly suitable copolymers (I) have a hydroxyl content of 5.4 to 6% by weight and a molecular weight in the range of 1500 to 2400. Such copolymers are marketed by Monsanto under the trade names RJ 100 and RJ 101 respectively.

The solubility of copolymer (I) in the non-polar liquid is easily controlled by varying the molar ratio of (A) and (B). The non-polar moiety (A) increases the solubility in the developer liquid. The presence of an esterified group in structural unit (B) tends to increase further the solubility of copolymer (I) in said liquid.

The presence of free hydroxyl in the polar moiety (B) makes the copolymer (I) precipitate onto the dispersed particulate colouring substance, e.g. carbon black, so that a good adherence is obtained on an aluminium support later on.

The preparation of allyl alcohol-styrene copolymers (I) is described by Schildknecht in "Allyl Compounds and their Polymers" Vol. 28, p. 204–206, (1973) J. Wiley & Sons, Interscience Publishers.

The procedure for preparing partial fatty acid esters of styrene-allyl alcohol copolymers by either a fusion cook or by an azeotropic cooking procedure is described in Technical Service Bulletin "RJ-100" for solvent-based vehicles (1963) of Monsanto.

Preferred copolymers (II) have a molecular weight of at least 40,000. Examples thereof are listed in Table 1.

Table 1

| Copolymer (II) no. | Trade name | Average molecular weight |
|---|---|---|
| 1 | NEOCRYL B702 | 70,000 |
| 2 | NEOCRYL B707 | 100,000 |
| 3 | PLEXOL 618 | 300,000 |

NEOCRYL B702 is a trade name of Polyvinyl Chemie Holland, Waalwijk, Netherlands, for a copolymer of isobutyl methacrylate, stearyl methacrylate, and methacrylic acid. NEOCRYL B702 has the following structure:

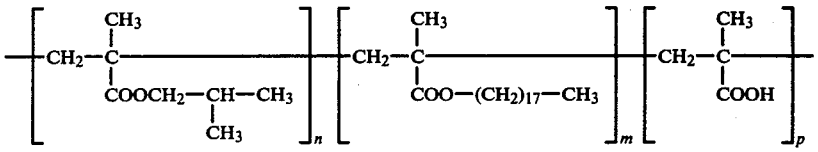

wherein:

n=from 75 to 85% by weight, m=15 to 25% by weight, p=about 0.2% by weight.

NEOCRYL B707 is a trade name of Polyvinyl Chemie Holland, Waalwijk, Netherlands, for a copolymer of m- and p-vinyltoluene, isobutyl methacrylate, and stearyl methacrylate corresponding to the following formula:

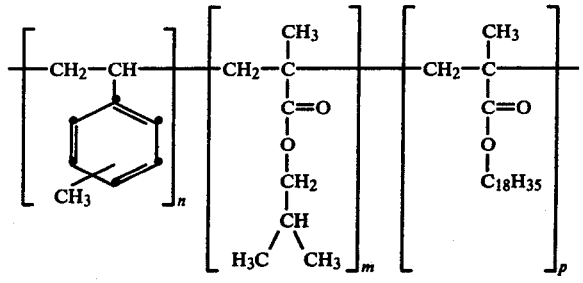

wherein:

n=60% by weight, y=20% by weight, p=20% by weight.

PLEXOL 618 is a trade name of Rohm & Haas, Philadelphia, Pa., USA for a copolymer having the following structure:

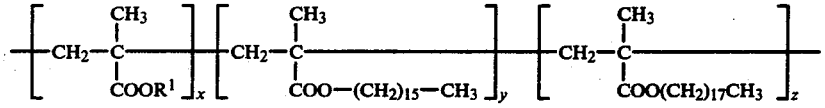

wherein:

$R^1$=n-butyl, x=56% by weight, y = 26% by weight, z=18% by weight.

The insulating liquid used as carrier liquid in the liquid developer according to the invention may be any kind of non-polar, fat-dissolving solvent. The insulating liquid used as carrier liquid preferably has a volume resistivity of at least $10^9$ Ohm.cm and a dielectric constant of less than 3. Said liquid preferably is a hydrocarbon solvent, e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons preferably having a boiling range between 150° C. and 220° C. such as the ISOPARS G, H, K and L (trade marks) of Exxon and SHELLSOL T (trade mark) of the Shell Oil Company.

The colouring substance used in the toner particles may be any inorganic pigment (said term including carbon) or solid organic dyestuff pigment commonly employed in liquid electrostatic toner compositions. Thus, for example, use can be made of carbon black and analogous forms thereof, e.g. lamp black, channel black, and furnace black, e.g. RUSS PRINTEX 140 GE-PERLT (trade name of Degussa, Frankfurt/M, W. Germany).

Typical solid organic dyestuffs are so-called pigment dyes, which include phthalocyanine dyes, e.g. copper phthalocyanines, metal-free phthalocyanine, azo dyes, and metal complexes of azo dyes.

The following dyes in pigment form are given for illustration purposes only: FANALROSE B Supra Pulver (trade name of Badische Anilin- & Soda-Fabrik AG, Ludwigshafen, Western Germany), HELIOGENBLAU LG (trade name of BASF for a metal-free phthalocyanine blue pigment), MONASTRAL BLUE (a copper phthalocyanine pigment, C.I. 74,160). HELIOGENBLAU B Pulver (trade name of BASF), HELIOECHTBLAU HG (trade name of Bayer AG, Leverkusen, Western Germany, for a copper phthalocyanine C.I. 74,160), BRILLIANT CARMINE 6B (C.I. 18,850), and VIOLET FANAL R (trade name of BASF, C.I. 42,535).

Typical inorganic pigments include black iron(III) oxide and mixed copper(II) oxide/chromium(III) oxide/iron(III) oxide powder, milori blue, ultramarine cobalt blue, and barium permanganate. Further are mentioned the pigments described in the French Patent Nos. 1,394,061 and 1,439,323.

Preferred carbon black pigments are marketed by Degussa under the trade name PRINTEX. PRINTEX 140 and PRINTEX G are preferably used in the developer composition of the present invention. The characteristics of said carbon blacks are listed in the following Table 2.

Table 2

| | PRINTEX 140 | PRINTEX G |
|---|---|---|
| origin | channel black | furnace black |
| density | 1.8 g · cm$^{-3}$ | 1.8 g · cm$^{-3}$ |
| grain size before entering the developer | 29 nm | 51 nm |
| oil number (g of linseed oil adsorbed by 100 g of pigment) | 360 | 250 |
| specific surface (sq.m per g) | 96 | 31 |
| volatile material % by weight | 6 | 2 |
| pH | 5 | 8 |
| colour | brownish-black | bluish-black |

As colour corrector for the PRINTEX pigments minor amounts of copper phthalocyanine may be used, e.g. from 1 to 20 parts by weight with respect to the carbon black.

For a given charge density of the charge-carrying surface the maximum development density attainable with toner particles of a given size is determined by the charge/toner particle mass ratio, which is determined substantially by the amount of employed substance conctrolling the electrical polarity.

In contrast with dry toners the liquid-suspended toner particles acquire normally their negative or positive charge from a chemical dissociation reaction on the toner particle surface and the introduction of a charged species in the carrier liquid to form the counterion. The principal charging mechanisms operating with a dissociation reaction are described, e.g., by Robert B. Comizolli et al. in Proceedings of the IEEE, Vol. 60, No. 4, April 1972, p. 363–364.

So, a liquid developer composition according to the present invention includes at least one substance (called "charge control" agent or substance), which influences or is responsible for electrical charging of the toner. The charge control substance(s) may have positive or negative charging effect. Mostly oil-soluble ionogenic substances (surfactants), e.g. metallic salts of organic acids with long aliphatic chain (e.g. containing at least 6 carbon atoms), are used for that purpose. By predominant adsorption of one ionic species the toner particles receive a net charge, whose amount can be regulated by changing the additive concentration. In this way the sensitivity of the toner (i.e. deposited mass per surface charge) can be controlled. The polarity can be determined by appropriate choice of the surfactant. For example, a suspension of carbon black in liquid isoparaffins becomes negatively charged by overbased calcium petroleum sulphonate and positively charged by calcium diisopropyl salicylate. Mixtures of different charge control agents can be used. For example, a mixture of different charge control agents having opposite charging effects can be used so that the strength of the charge on the toner or the polarity thereof can be adjusted by varying the ratio between the different agents (see U.K. Patent applications Nos. 1,411,287; 1,411,537 and 1,411,739). Particularly suitable positively working charge control substances are described in the U.K. Pat. Specification No. 1,151,141. These substances called charge control agents are bivalent or trivalent metal salts of:

(a) a monoester or diester of an oxyacid derived from phosphorus,
(b) an oxyacid derived from phosphorus and containing one or two organic groups linked to the phosphorus atom by a carbon atom, or
(c) an oxyacid derived from phosphorus and containing an ester group and an organic group linked by a carbon atom to the phosphorus atom, said organic group being aliphatic, cycloaliphatic, or aromatic.

The organic group preferably comprises a chain of at least 4 carbon atoms, most preferably from 10 to 18 carbon atoms and such chain may be substituted and/or interrupted by hetero-atom(s), e.g., oxygen, sulphur, or nitrogen atom(s).

Particularly good results are obtained with the zinc salts. However, other salts may also be used, e.g. salts of magnesium, calcium, strontium, barium, iron, cobalt, nickel, copper, cadmium, aluminium, or lead.

The solubility in the electrically insulating carrier liquid of such metal salts can be promoted by the presence of one or more organic groups with branched structure, e.g. branched aliphatic groups, such as 2-butyl-octyl group.

Other particularly suitable positively working charge control agents that are of special interest in the production of an electrophoretic developer with low charge/toner particle mass ratio are described in the U.K. Patent Application No. 38,068/75. That application discloses developer compositions, which contain as control agent a metal alkyl sulphonate whose metal ion is a bivalent metal ion selected from the group consisting of zinc(II), lead(II), cadmium(II), and copper(II) or is a trivalent metal ion of the group VIII of the Periodic Table of the Elements, e.g. iron(III) or of the group IV B e.g. chromium(III), and in which the sulphonate group is present directly on an alkyl chain containing at least 6 carbon atoms in straight line. When a said sulphonate is used as a charge control agent in a developer composition according to the present invention, the sizes of the toner particles and the amount in which said sulphonate is present may (as described in the aforesaid earlier application 36068/75) be such that the toner can develop up to an optical density of at least 0.8, a charge pattern possessing a charge level corresponding to 50 V for a capacitance of $1.5\times10^{-11}$ F.cm$^{-2}$. A suitable amount of the sulphonate for a given toner developer can easily be determined by simple tests. By using a said metal alkyl sulphonate as charge control agent the specified results can be achieved with toner particles of a size commonly used in the electrophotographic art, e.g., with toner particles sizing in the range of 0.2 μm to 2 μm. As disclosed in said application an additional charge control agent can be used in conjunction with the metal alkyl sulphonate. A useful amount of these positively charging substances is in the range of 0.5 to 5% by weight with respect to the dispersed colouring substance, e.g., carbon black.

Particularly suitable negatively working charge control agents are described in U.K. Patent Application No. 3805/76. That application discloses developer compositions, which contain as control agent an oil-soluble overbased alkaline earth metal hydrocarbon sulphonate, whose metal is magnesium, calcium, or barium. Said sulphonate has an average molecular weight of at least 800 and a total base number (TBN) determined according to ASTM D 664-58 of at least 2. A useful amount of these negatively charging substances is in the range of 1 to 40% by weight with respect to the dispersed colouring substance.

A liquid developer composition according to the present invention can be prepared by using dispersing and mixing techniques well known in the art. It is conventional to prepare by means of suitable mixers, e.g. kneading apparatus, a 3-roll mill, ball mill, colloid mills, high speed stirrers, a concentrate of e.g. 15 to 80% by weight of the solid materials selected for the composition in the insulating carrier liquid and subsequently to add further insulating carrier liquid to provide the liquid toner composition ready for use in the electrostatic reproduction process. It is generally suitable for a ready for use electrophoretic liquid developer to incorporate the toner in an amount between 1 g and 20 g per liter, preferably between 2 g and 10 g per liter. The copolymers can be applied as a pre-coating to the pigment particles prior to their use in making up the developer or can be introduced as a separate ingredient in the liquid and allowed to adsorb onto the pigment particles. It is preferable to precoat the colouring substance with copolymer (I) and to add in the presence of the charge-control agent copolymer (II), which offers a particularly high stability to the toner.

The electrophoretic development may be carried out by using any known electrophoretic development technique or device. The field of the image to be developed may be influenced by the use of a development electrode. The use of a development electrode is of particular value in the development of continuous tone images. When no development electrode is used, the developed image may exhibit exaggerated density gradients, which may be of interest for certain purposes in graphic arts.

The charge pattern to be developed may be obtained according to any known electrostatographic technique, which includes direct image-wise charging of a dielectric, e.g. by means of a charge stylus through photoelectron emission or ionography or image-wise discharging of a photoconductor medium, e.g. a selenium drum or photo-conductive zinc oxide sheet or plate. Toner transfer from a toner image still being wet proceeds e.g. by electrophoresis. A description of this technique is presented in the published German Patent Application Nos. 2,144,066 and 2,147,646 filed by Canon, 2 and 9 September 1971 respectively.

A planographic printing master obtained by transfer of toner according to the present invention on an aluminium plate forms after fixing by heat, a very robust printing image that can yield printing runs of 50,000 to 100,000 prints with good resolution (about 60 line pairs per cm).

Planographic aluminium printing plates are made fatty ink-repellent and highly water-accepting in the areas not covered by toner according to known wetting techniques, e.g. by treating the plate carrying the toner image with an aqueous solution containing phosphoric acid. Suitable treating liquids for that purpose are described, e.g., in the U.S. Pat. No. 3,300,306 under the wording "lithographic preparation".

The following examples illustrate the present invention. The ratios and percentages are by weight unless otherwise indicated.

EXAMPLE 1

Preparation of the liquid toner developer with positively charged toner particles 200 g of the styrene-allyl alcohol copolymer RJ 100 (trade name) resin (average molecular weight 1600) and 100 g of PRINTEX G carbon black (trade name) were introduced in a kneading apparatus type LILIPUT 030 C.N. (trade name) sold by Meili (Switzerland).

The kneading apparatus was heated with circulating silicone oil at 110° C. till the temperature of the kneaded mass reached 90° C. After 2 h of kneading, the mass was cooled, broken, and ground in a grinding apparatus IKA model A 10 (sold by Janke & Kunkel, W. Germany) so as to obtain a fine powder of carbon black precoated with RJ 100 resin having a particle diameter of about 50 to 100 μm.

A liquid toner was prepared by milling the following ingredients for 15 h in a vibratory ball mill:

42 g of carbon black precoated with RJ 100 (trade name) resin 42 g of a 30% by weight solution of NEOCRYL B 702 (trade name) in ISOPAR G (trade name of Exxon for an aliphatic hydrocarbon having a boiling range of 160°–175° C. and a Kauri-butanol (KB) value of 27)

14 ml of a 2% (weight/volume) solution of zinc mono-2-butyloctyl phosphate in isododecane 150 ml of isododecane.

The above toner had a particle diameter of 0.40 μm and a very good stability and shelf-life in the toner concentrate form as well as in the development concentration.

Development and Transfer 7.5 ml of the above concentrated liquid developing composition were diluted with 1 liter of isododecane, which yield a stable positive working electrophoretic developer.

An electrostatic image formed on a conventional electrophotograhic recording element, i.e. paper coated with photoconductive zinc oxide dispersed in a resinous binder, which was negatively charged and image-wise exposed to light, was developed with the developer obtained.

The transfer of the electrophoretically deposited toner proceeded by applying a negative voltage of 3 kV to a metal roll, which was kept in close ohmic contact with the rear side of an aluminium sheet acting as the receiving material which was kept with its front side in close contact with the wet image on the photoconductor.

After toner transfer by electrophoresis, the image-wise deposited toner particles were fixed on the aluminium by heating the sheet at 120° C. for 20 s.

The transferred toner image was of excellent quality with respect to abrasion resistance and image resolution. The non-image areas of the aluminium plate were hydrophilized in a known way e.g. by means of an aqueous phosphoric acid solution so as to obtain an electrophotograhic offset master.

The resolution of this master was about 60 line pairs per cm and more than 50,000 prints of high quality were made on a conventional offset machine.

EXAMPLE 2

Example 1 was repeated but instead of using RJ 100 (trade name) as coating copolymer for the carbon black, RJ 101 (trade name) being a styrene-allyl alcohol copolymer with average molecular weight (about 1700) was used. The same good results as in Example 1 were obtained.

EXAMPLE 3

Preparation of a liquid toner developer with negatively charged toner particles A liquid toner dispersion was prepared by milling in a vibratory ball mill the following ingredients for 15 h:

42 g of carbon black precoated with RJ 100 (trade name) resin as in Example 1, 42 g of a 30% solution of Neocryl B702 (trade name) in Isopar G (trade name)

14 ml of a 20% (weight/volume) solution of TLA 414 (trade name of Texaco for an oil-soluble overbased calcium hydrocarbon sulphonate with a total base number of 400)

150 ml of isododecane.

The thus obtained toner dispersion contained negatively charged toner. The dispersion had a very good stability and shelf-life in the toner concentrate form as well as in the development concentration. The latter concentration was obtained by diluting 7.5 ml of the above toner concentrate with 1 liter of isododecane.

Development and transfer

An electrostatic image formed on a selenium drum, which was positively charged and image-wise exposed to light, was developed with the negatively charged developer.

To transfer the toner particles of the obtained image onto plain paper a positive voltage of 3 kV was applied to the rear side of the paper, which was used as receiving material. The transferred toner particles were fixed by heating the sheet at 120° C. for 20 s or by flash-exposure.

The image obtained had a high density and good sharpness.

EXAMPLE 4

Preparation A 200 g of RJ 100 (trade name), which had been esterified with stearic acid so as to contain still 0.74% of hydroxyl groups and 100 g of PRINTEX G (trade name) were melt-kneaded until a homogeneous dispersion of carbon black in the polymer mass was obtained.

Preparation B 100 g of RJ 100 (trade name) and 100 g of RJ 100 (trade name), which had been esterified with lauric acid so as to contain still 0.74% of hydroxyl groups, and 100 g of PRINTEX G (trade name) were melt-kneaded until a homogeneous dispersion of carbon black was obtained.

Preparation C 100 g of RJ 100 (trade name), 100 g of hydroabietyl/-methyl acrylate/isobutyl methacrylate copolymer, and 100 g of PRINTEX G (trade name) were melt-kneaded until a homogeneous dispersion of carbon black in the polymer was obtained.

The carbon black precoated with resin as described in preparations A, B, and C was used for preparing toner dispersions in the way described in Example 1 or 3.

We claim:

1. A liquid developer composition suitable for use in developing electrostatic charge patterns, which composition contains in an electrically insulating non-polar carrier liquid a dispersed particulate colouring substance, one or more charge control substances, a copolymer (I) pre-coating for said colouring substance particles in a weight ratio of copolymer (I) to colouring substance wherein 1:1 and 9:1 and a copolymer (II) in said carrier liquid in a weight ratio of copolymer (II) to colouring substance between 0.5:1 and 5:1, said copolymer (I) being a copolymer consisting of 50 to 90 mole % of recurring units of the following formula (A)

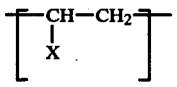

(A)

wherein X is phenyl or alkylphenyl, and from 10 to 50 mole % of recurring units of the following formula (B)

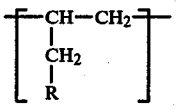

(B)

wherein R is a hydroxyl group or is a group resulting from the esterification of hydroxyl with a $C_{12}$–$C_{20}$ aliphatic acid with the proviso that the copolymer (I) contains at least 0.5% by weight of free hydroxyl groups, and said copolymer (II) being a copolymer selected from the group consisting of a copolymer of at least one $C_{12}$–$C_{20}$ alkyl ester of methacrylic acid (X) and the n-butyl or isobutyl ester of methacrylic acid (Y)

a copolymer of X, Y and up to 70% by weight of styrene or a styrene homologue, and a copolymer of X, Y and up to 0.4% by weight of methacrylic acid, the weight ratio of X to Y in these copolymers being comprised between 15:85 and 50:50.

2. A liquid developer composition according to claim 1 or 2, wherein the hydroxyl content of the copolymer (I) is from 5.4 to 6% by weight and the copolymer (I) has a molecular weight in the range of 1500 to 2400.

3. A liquid developer composition according to claim 1, wherein the copolymer (II) has a molecular weight of at least 40,000.

4. A liquid developer composition according to claim 3, wherein the copolymer (II) has the following structure:

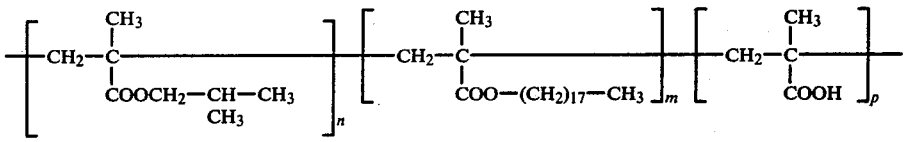

wherein: n = from 75 to 85% by weight
m = 15 to 25% by weight
p = about 0.2% by weight.

5. A liquid developer composition according to claim 1, wherein the carrier liquid has a volume resistivity of at least $10^9$ Ohm.cm and a dielectric constant of less than 3.

6. A liquid developer composition according to claim 5, wherein the carrier liquid is an aliphatic hydrocarbon.

7. A liquid developer composition according to claim 1, wherein the colouring substance is carbon black.

8. A liquid developer composition according to claim 1, wherein the composition comprises a charge-control substance, which imparts a positive charge to the dispersed particulate substance.

9. A liquid developer composition according to claim 1, wherein the composition comprises a charge-control substance, which imparts a negative charge to the dispersed particulate substance.

10. A liquid developer composition according to claim 1, wherein the charge-control substance is a metallic salt of an organic acid with an aliphatic chain having at least 6 carbon atoms.

11. A liquid developer composition according to claim 8, wherein as charge-control substance is present a bivalent or trivalent metal salt of (a) a monoester or diester of an oxyacid derived from phosphorus,
(b) an oxyacid derived from phosphorus and containing one or two organic groups linked to the phosphorus atom by a carbon atom, or
(c) an oxyacid derived from phosphorus and containing an ester group and an organic group linked by a carbon atom to the phosphorus atom, the said organic group being aliphatic, cycloaliphatic or aromatic.

12. A liquid developer composition according to claim 1, wherein as charge-control substance is present a metal alkyl sulphonate, in which the metal ion is a bivalent metal ion selected from the group consisting of zinc(II), lead(II), cadmium(II) and copper(II) or is a trivalent metal ion of the group VIII of the Periodic Table of the Elements, and in which the sulphonate group is present directly on an alkyl chain containing at least 6 carbon atoms in a straight line.

13. A method of forming a liquid developer composition suitable for use in developing electrostatic charge patterns and comprising charged toner suspended in an electrically insulating carrier liquid, which method comprises introducing in said liquid (a) particulate colouring substance precoated with a copolymer (I) and (b) a copolymer (II) in the presence of at least one charge-control substance said copolymer (I) being a copolymer consisting of 50 to 90 mole % of recurring units of the following formula (A)

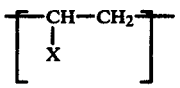

(A)

wherein X is phenyl or alkylphenyl, and from 10 to 50 mole % of recurring units of the following formula (B)

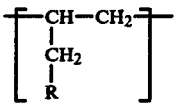

(B)

wherein R is a hydroxyl group or is a group resulting from the esterification of hydroxyl by means of a $C_{12}$–$C_{20}$ aliphatic acid with the proviso that the copolymer (I) contains at least 0.5% by weight of free hydroxyl groups, and said copolymer (II) being a copolymer selected from the group consisting of a copolymer of at least one $C_{12}$–$C_{20}$ alkyl ester of methacrylic acid (X) and the n-butyl or isobutyl ester of methacrylic acid (Y)

a copolymer of X, Y and up to 70% by weight of styrene or a styrene homologue, and a copolymer of X, Y and up to 0.4% by weight of methacrylic acid, the weight ratio of X to Y in these copolymers being comprised between 15:85 and 50:50, the amount of copolymer (I) introduced in said liquid with respect to the colouring substance being in a weight ratio range of 1:1 to 9:1 and the amount of copolymer (II) introduced in said liquid with respect to the colouring substance being in a weight ratio range of 0.5:1 to 5:1.

* * * * *